US010777108B2

(12) United States Patent
Pyun et al.

(10) Patent No.: US 10,777,108 B2
(45) Date of Patent: Sep. 15, 2020

(54) DISPLAY DEVICE AND METHOD OF DRIVING THE SAME

(71) Applicant: Samsung Display Co., Ltd., Yongin-Si, Gyeonggi-Do (KR)

(72) Inventors: Kihyun Pyun, Gwangmyeong-si (KR); Seung-woon Shin, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/190,423

(22) Filed: Nov. 14, 2018

(65) Prior Publication Data

US 2019/0147782 A1 May 16, 2019

(30) Foreign Application Priority Data

Nov. 16, 2017 (KR) ..... 10-2017-0153373

(51) Int. Cl.
*G09G 3/00* (2006.01)
*G09G 3/36* (2006.01)

(52) U.S. Cl.
CPC ..... *G09G 3/006* (2013.01); *G09G 3/3677* (2013.01); *G09G 3/3696* (2013.01); *G09G 2310/08* (2013.01); *G09G 2320/041* (2013.01); *G09G 2330/026* (2013.01)

(58) Field of Classification Search
None
See application file for complete search history.

(56) References Cited

U.S. PATENT DOCUMENTS

| | | | | |
|---|---|---|---|---|
| 6,414,740 | B1 | 7/2002 | Hosoyamada | |
| 8,659,583 | B2 | 2/2014 | Cho | |
| 9,081,234 | B2 | 7/2015 | Yang et al. | |
| 9,881,547 | B2 | 1/2018 | Eom | |
| 2008/0062100 | A1* | 3/2008 | Hong | G09G 3/3696 345/87 |
| 2009/0021669 | A1 | 1/2009 | Lee et al. | |
| 2017/0004765 | A1* | 1/2017 | Tani | G09G 3/3275 |

FOREIGN PATENT DOCUMENTS

| | | | |
|---|---|---|---|
| KR | 100386733 | B1 | 6/2003 |
| KR | 1020050082779 | A | 8/2005 |
| KR | 1020090008950 | A | 1/2009 |
| KR | 100992135 | B1 | 11/2010 |
| KR | 1020160040398 | A | 4/2016 |

* cited by examiner

*Primary Examiner* — Kenneth B Lee, Jr.
(74) *Attorney, Agent, or Firm* — Cantor Colburn LLP

(57) ABSTRACT

A display device includes a display panel which includes gate lines and data lines, a gate driver electrically connected to the gate lines, a temperature sensor which includes at least three temperature sensing circuits which are disposed adjacent to the gate driver, and a voltage generating circuit which outputs a test voltage to each of the temperature sensing circuits and outputs a clock signal, which is compensated based on a result voltage having a lowest voltage level among result voltages provided from the temperature sensing circuits, to the gate driver.

20 Claims, 8 Drawing Sheets

DISPLAY DEVICE AND METHOD OF DRIVING THE SAME

This application claims priority to Korean Patent Application No. 10-2017-0153373, filed on Nov. 16, 2017, and all the benefits accruing therefrom under 35 U.S.C. § 119, the content of which in its entirety is herein incorporated by reference.

BACKGROUND

1. Field of Disclosure

The invention relates to a display device having a temperature compensation function and a method of driving the display device.

2. Description of the Related Art

A display device generally includes a display panel displaying an image and a driving circuit driving the display panel. The display panel includes gate lines, data lines, and pixels. The driving circuit generates various driving voltages required for an operation the display panel.

Operating characteristics of the driving circuit varies due to a difference in charge mobility depending on a temperature.

SUMMARY

Particularly, when the charge mobility decreases in a low-temperature environment, the pixels are not sufficiently turned on.

The invention provides a display device capable of compensating for lowered mobility of charges of gate drivers at a low temperature depending on a positional relationship with a light source unit.

The invention provides a method of driving the display device.

Exemplary embodiments of the inventive concept provide a display device including a display panel which includes a plurality of gate lines extending in a first direction and a plurality of data lines extending in a second direction crossing the first direction, a gate driver electrically connected to the gate lines, a temperature sensor which includes at least three temperature sensing circuits which are disposed adjacent to the gate driver, and a voltage generating circuit which outputs a test voltage to each of the temperature sensing circuits and outputs a clock signal, which is compensated based on a result voltage having a lowest voltage level among result voltages provided from the temperature sensing circuits, to the gate driver.

In an exemplary embodiment, each of the temperature sensing circuits may include a plurality of diode-connected transistors connected to each other in series.

In an exemplary embodiment, the gate driver may include a first gate driver and a second gate driver, the first gate driver and the second gate driver may be disposed spaced apart from each other such that the gate lines are disposed between the first gate driver and the second gate driver, and the temperature sensing circuits may be disposed adjacent to the first gate driver or the second gate driver in the first direction.

In an exemplary embodiment, the display panel may include a first area, a second area, and a third area, which are sequentially defined in the second direction, and the temperature sensor may include a first temperature sensing circuit disposed in the first area, a second temperature sensing circuit disposed in the second area, and a third temperature sensing circuit disposed in the third area.

In an exemplary embodiment, at least one temperature sensing circuit among the first, second, and third temperature sensing circuits may be disposed adjacent to the first gate driver, and at least one remaining temperature sensing circuit among the first, second, and third temperature sensing circuits may be disposed adjacent to the second gate driver.

In an exemplary embodiment, the temperature sensor may further include a fourth temperature sensing circuit disposed in the first area, a fifth temperature sensing circuit disposed in the second area, and a sixth temperature sensing circuit disposed in the third area, the first, second, and third temperature sensing circuits may be disposed adjacent to the first gate driver, and the fourth, fifth, and sixth temperature sensing circuits may be disposed adjacent to the second gate driver.

In an exemplary embodiment, a number of first diode-connected transistors included in the first temperature sensing circuit, a number of second diode-connected transistors included in the second temperature sensing circuit, and a number of third diode-connected transistors included in the third temperature sensing circuit may be equal to each other.

In an exemplary embodiment, a sum of the number of first diode-connected transistors, the number of second diode-connected transistors, and the number of third diode-connected transistors may be equal to a number of the gate lines.

In an exemplary embodiment, the first temperature sensing circuit may include a first switch, the second temperature sensing circuit may include a second switch, the third temperature sensing circuit may include a third switch, and the first, second, and third switches may be sequentially turned on, receive the test voltage from the voltage generating circuit, and output the result voltage changed depending on a temperature of the first gate driver or the second gate driver adjacent thereto to the voltage generating circuit.

In an exemplary embodiment, the voltage generating circuit may include a switch signal generator which generates a signal to sequentially turn on the first switch, the second switch, and the third switch, a voltage output and sensing unit which outputs the test voltage and receiving the result voltages, a compensation reference determination unit which compares voltage drops from the test voltage to the result voltages to determine a compensation reference, and a compensator which compensates for the clock signal based on the compensation reference.

In an exemplary embodiment, the diode-connected transistors included in each of the temperature sensing circuits may be arranged along the second direction.

Exemplary embodiments of the inventive concept provide a display device including a display panel which includes a plurality of gate lines extending in a first direction and a plurality of data lines extending in a second direction crossing the first direction and includes a first area, a second area, and a third area, which are sequentially defined along the second direction, a gate driver which outputs a gate signal to the gate lines and disposed in the first, second, and third areas, a temperature sensor which includes a first temperature sensing circuit disposed in the first area, a second temperature sensing circuit disposed in the second area, and a third temperature sensing circuit disposed in the third area which are adjacent to the gate driver, and a voltage generating circuit which outputs a test voltage to each of the first, second, and third temperature sensing circuits and outputs a clock signal, which is compensated based on first, second, and third result voltages provided from the first, second, and third temperature sensing circuits respectively, to the gate driver.

In an exemplary embodiment, the voltage generating circuit may compare the test voltage with each of the first, second, and third result voltages and compensate for the clock signal based on a voltage having a largest voltage drop among voltage drops from the test voltage to the first, second, and third result voltages.

In an exemplary embodiment, the gate driver may include a first gate driver and a second gate driver, the first gate driver and the second gate driver may be disposed to be spaced apart from each other such that the gate lines are disposed between the first gate driver and the second gate driver, and the first, second, and third temperature sensing circuits may be disposed adjacent to the first gate driver or the second gate driver in the first direction.

In an exemplary embodiment, at least one temperature sensing circuit among the first, second, and third temperature sensing circuits may be disposed adjacent to the first gate driver, and at least one remaining temperature sensing circuit among the first, second, and third temperature sensing circuits may be disposed adjacent to the second gate driver.

In an exemplary embodiment, the temperature sensor may further include a fourth temperature sensing circuit disposed in the first area, a fifth temperature sensing circuit disposed in the second area, and a sixth temperature sensing circuit disposed in the third area, the first, second, and third temperature sensing circuits may be disposed adjacent to the first gate driver, and the fourth, fifth, and sixth temperature sensing circuits may be disposed adjacent to the second gate driver.

In an exemplary embodiment, each of the first, second, and third temperature sensing circuits may include a plurality of diode-connected transistors connected to each other in series.

Exemplary embodiments of the inventive concept provide a method of driving a display device, which includes a display panel including a gate driver and first, second, and third temperature sensing circuits integrated in an area adjacent to the gate driver, including sequentially providing a test voltage to the first, second, and third temperature sensing circuits, sequentially receiving first, second, and third result voltages, which are voltage-dropped from the test voltage, from the first, second, and third temperature sensing circuits respectively, comparing the test voltage with each of the first, second, and third result voltages, and controlling a voltage level of a clock signal applied to the gate driver based on a result voltage having a largest voltage drop among the first, second, and third result voltages.

In an exemplary embodiment, the test voltage may be provided after a predetermined time elapses from a time point at which the display device is turned on.

In an exemplary embodiment, the method may further include generating a switch signal to provide the test voltage to one of the first, second, and third temperature sensing circuits.

According to the above, although a positional relationship between the display panel and the light source unit is changed, the voltage level of gate-on and -off voltage is compensated based on the result voltage having the largest voltage drop among the result voltages sensed by the temperature sensing circuits. That is, the voltage level of gate-on and -off voltage may be compensated for the lowered mobility of the charges of the thin film transistors at the lowest temperature. Accordingly, the phenomenon in which the pixel is not sufficiently turned on may be effectively prevented from occurring.

BRIEF DESCRIPTION OF THE DRAWINGS

The above and other advantages of the invention will become readily apparent by reference to the following detailed description when considered in conjunction with the accompanying drawings wherein.

DETAILED DESCRIPTION

Figure 1:
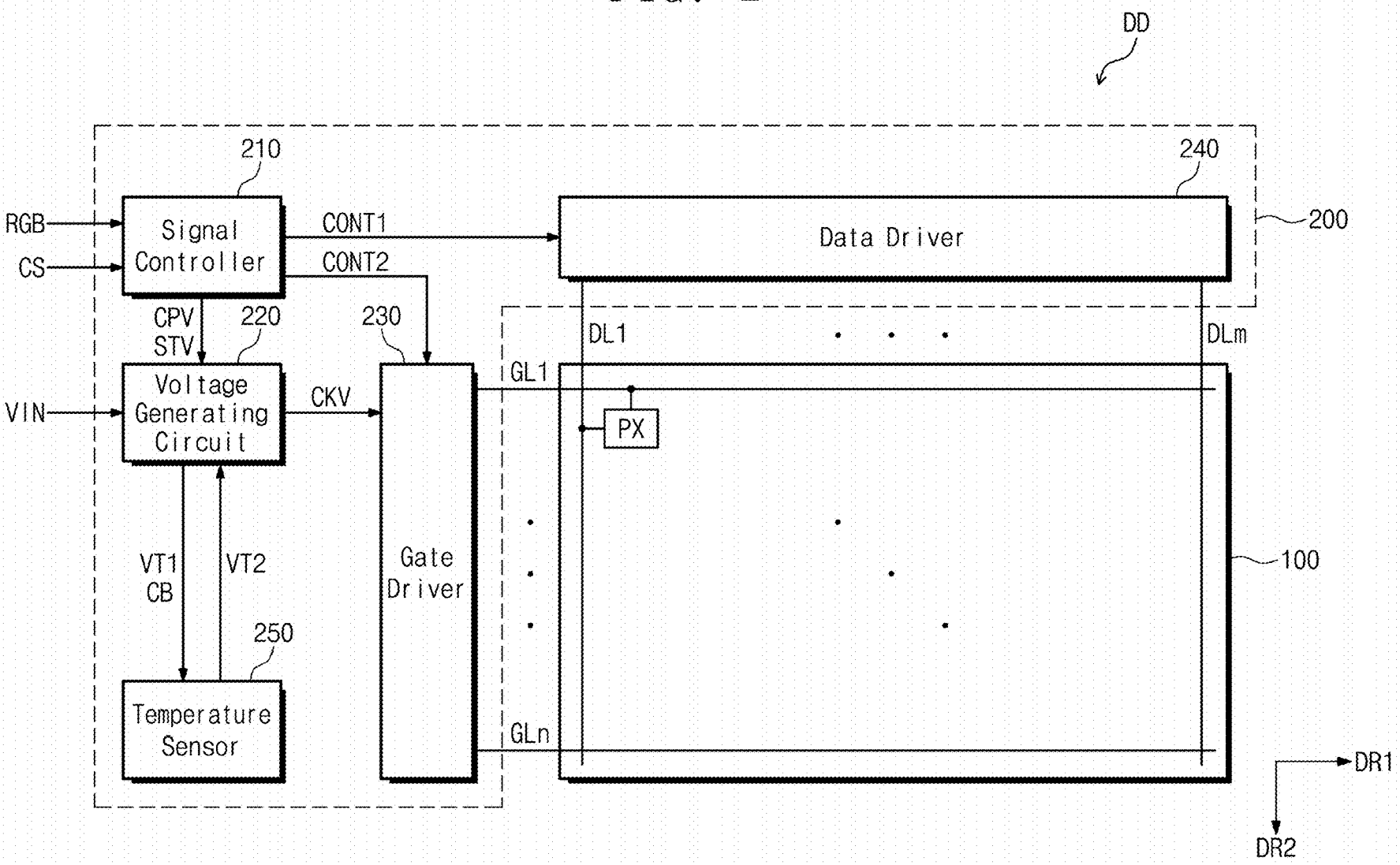
FIG. 1 is a block diagram showing an exemplary embodiment of a display device according to the invention.

The invention may be variously modified and realized in many different forms, and thus specific embodiments will be exemplified in the drawings and described in detail hereinbelow. However, the invention should trot be limited to the specific disclosed forms, and be construed to include all modifications, equivalents, or replacements included in the spirit and scope of the invention.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

The use of the terms first, second, etc. do not denote any order or importance, but rather the terms first, second, etc. are used to distinguish one element from another. Thus, a first element, component, region, layer or section discussed below could be termed a second element, component, region, layer or section without departing from the teachings of the invention. It is to be understood that the singular forms "a," "an," and "the" include plural referents unless the context clearly dictates otherwise. "At least one" is not to be construed as limiting "a" or "an." "Or" means "and/or."

In the drawings, proportions and dimensions of components are exaggerated for clarity. As used herein, the term "and/or" includes any and all combinations of one or more of the associated listed items.

Hereinafter, the invention will be explained in detail with reference to the accompanying drawings.

FIG. 1 is a block diagram showing an exemplary embodiment of a display device DD according to the invention.

Referring to FIG. 1, the display device DD includes a display panel 100 and a driving circuit 200. The driving circuit 200 includes a signal controller 210, a voltage generating circuit 220, a gate driver 230, a data driver 240, and a temperature sensor 250.

The display panel 100 generates an image corresponding to image data applied thereto. The display panel 100 may be, but not limited to, a liquid crystal display panel. In an exemplary embodiment, as an example, the display panel 100 may employ various display panels as long as the display panels are light-receiving type display panels.

The display panel 100 includes a plurality of data lines DL1 to DLm, a plurality of gate lines GL1 to GLn, and a plurality of pixels PX.

The gate lines GL1 to GLn extend in a first direction DR1 and are arranged in a second direction DR2 crossing the first direction DR1. The data lines DL1 to DLm extend in the second direction DR2 and are arranged in the first direction DR1.

The data lines DL1 to DLm and the gate lines GL1 to GLn define pixel areas, and the pixels PX are arranged in the pixel areas, respectively, and display the image. FIG. 1 shows a pixel PX connected to a first data line DL1 and a first gate line GL1 as a representative example.

The pixel PX displays one of primary colors or one of mixed colors. The primary colors include red, green, and blue colors, and the mixed colors include white, yellow, cyan, and magenta colors, but the color displayed by the pixel PX should not be limited thereto or thereby.

The signal controller 210 (or timing controller) receives control signals CS and image data RGB from an external source (not shown). The signal controller 210 transmits a first control signal CONT1 to the data driver 240 and transmits a second control signal CONT2 to the gate driver 230. The first control signal CONT1 is used to control the data driver 240, and the second control signal CONT2 is used to control the gate driver 230.

The voltage generating circuit 220 receives a power supply voltage VIN from the outside thereof and receives a clock control signal CPV and a vertical start signal STV from the signal controller 210.

The voltage generating circuit 220 generates driving voltages in response to the clock control signal CPV and the vertical start signal STV and generates clock signals CKV based on the driving voltages. Each clock signal CKV may have a waveform having a gate-on voltage level and a gate-off voltage level. The clock signals CKV may be applied to the gate driver 230.

The gate driver 230 transmits gate signals to the gate lines GL1 to GLn in response to the second control signal CONT2 from the signal controller 210. The gate driver 230 may be integrated in a predetermined area of the display panel 100. In an exemplary embodiment, the gate driver 230 may be implemented by a circuit including an amorphous silicon thin film transistor ("a-Si TFT") and using an amorphous silicon gate.

Due to temperature characteristics of the a-Si TFT for the gate driver 230, a difference in charge mobility may occur depending on the temperature of a-Si TFT. In particular, the mobility of the charges may be lowered at low temperature. When the gate-on voltage level applied to the gate lines GL1 to GLn becomes lower at low temperature, a phenomenon in which the pixel PX is not sufficiently turned on occurs. The driving circuit 200 includes the temperature sensor 250 to compensate for the lowered mobility of the charges at low temperature.

The temperature sensor 250 may be integrated in a predetermined area of the display panel 100. In detail, since the temperature sensor 250 is provided to compensate for the difference in charge mobility due to the temperature of the gate driver 230, the temperature sensor 250 may be disposed adjacent to the gate driver 230. The temperature sensor 250 receives a test voltage VT1 and a switch signal CB from the voltage generating circuit 220 and transmits a result voltage VT2 adjusted depending on the temperature to the voltage generating circuit 220.

The voltage generating circuit 220 controls the level of the gate-on voltage and/or the gate-off voltage based on the result voltage VT2 provided from the temperature sensor 250 and outputs the clock signal CKV to the gate driver 230.

The data driver 240 drives the data lines DL1 to DLm in response to the first control signal CONT1 provided from the signal controller 210. The data driver 240 may be electrically connected to one side of the display panel 100 as implemented in an independent integrated circuit or the data driver 240 may be directly mounted on the display panel 100. In an exemplary embodiment, the data driver 240 may be implemented in a single chip or includes a plurality of chips.

Figure 2:
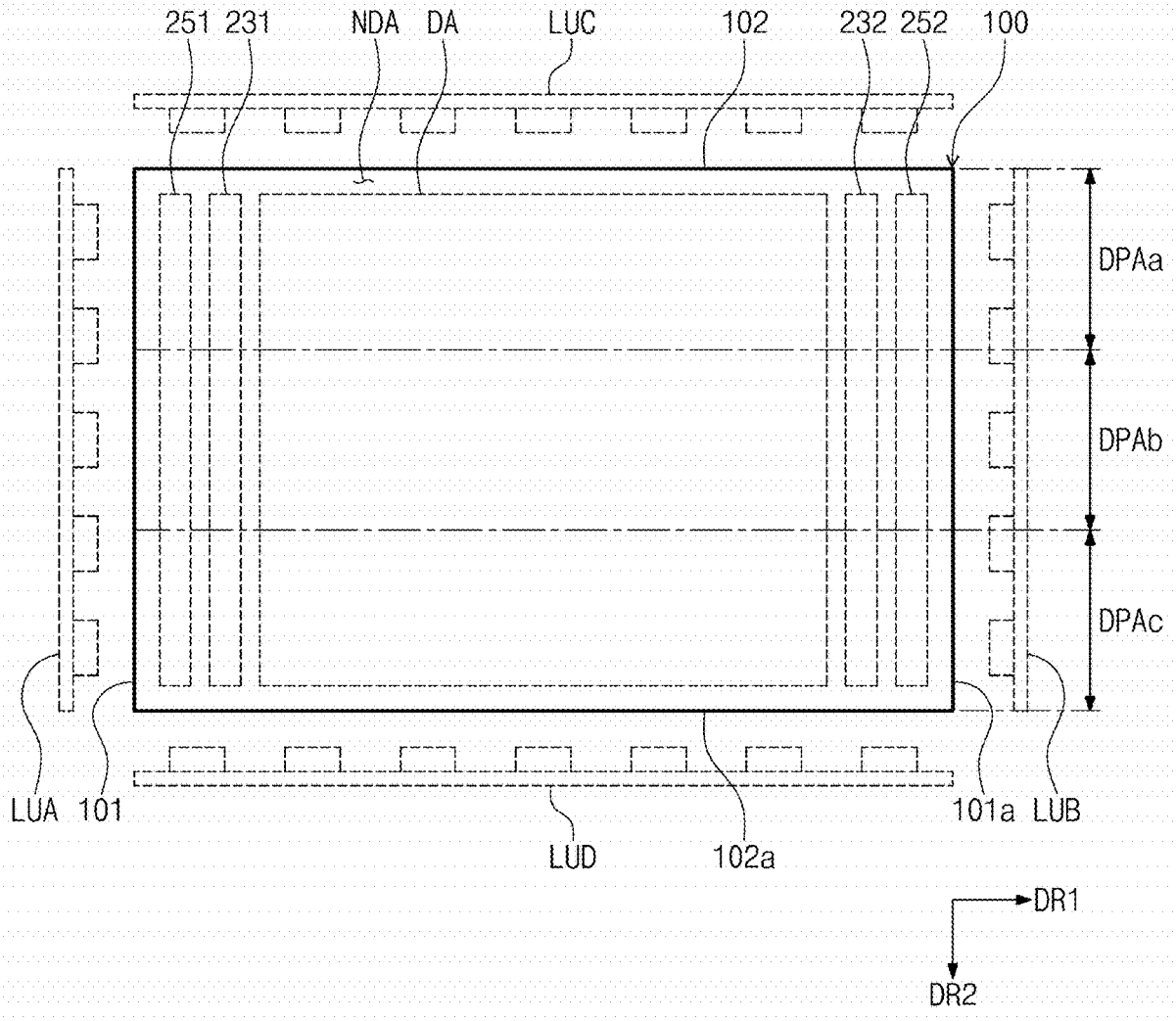
FIG. 2 is a plan view showing an exemplary embodiment of some elements of a display device according to the invention.

FIG. 2 is a plan view showing an exemplary embodiment of some elements of the display device DD according to the invention.

Referring to FIGS. 1 and 2, the display panel 100 includes a display area DA and a non-display area NDA. The display area DA displays the image, and the non-display area NDA does not display the image. The non-display area NDA surrounds the display area DA.

The data lines DL1 to DLm, the gate line GL1 to GLn, and the pixels PX are arranged in the display area DA, and the gate driver 230 and the temperature sensor 250 may be arranged in the non-display area NDA. Each of the signal controller 210, the voltage generating circuit 220, and the data driver 240 is electrically connected to one side of the display panel 100 as implemented in an independent integrated circuit, and these components are not shown in FIG. 2.

The gate driver 230 may include a first gate driver 231 and a second gate driver 232. In this case, the first gate driver 231 and the second gate driver 232 are disposed to be spaced apart from each other such that the display area DA is disposed between the first gate driver 231 and the second gate driver 232, but number of gate drivers and locations thereof should not be limited thereto or thereby. That is, the gate driver 230 may include only the first gate driver 231 or the second gate driver 232 in another exemplary embodiment.

Each of the first gate driver 231 or the second gate driver 232 includes a plurality of shift registers. The number of the shift registers is equal to or greater than the number of the gate lines GL1 to GLn (refer to FIG. 1). In an exemplary embodiment, as an example, the first gate driver 231 includes "n" shift registers, the second gate driver 232 includes "n" shift registers, and one gate line is connected to both the first gate driver 231 and the second gate driver 232. In addition, according to another exemplary embodiment, the first gate driver 231 includes "n/2" shift registers, the second gate driver 232 includes "n/2" shift registers, some gate lines of the gate lines GL1 to GLn are connected to the first gate driver 231, and the other gate lines of the gate lines GL1 to GLn are connected to the second gate driver 232.

The temperature sensor 250 may include a first temperature sensor 251 and a second temperature sensor 252. The first temperature sensor 251 is disposed adjacent to the first gate driver 231, and the second temperature 252 is disposed adjacent to the second gate driver 232. The first temperature sensor 251 is disposed spaced apart from the first gate driver 231 in the first direction DR1, and the second temperature sensor 252 is disposed spaced apart from the second gate driver 232 in the first direction DR1.

According to another exemplary embodiment, in a case that the gate driver 230 includes only the first gate driver 231, the second temperature sensor 252 is omitted, and in a case that the gate driver 230 includes only the second gate driver 232, the first temperature sensor 251 is omitted. The temperature sensor 250 may be substantially simultaneously provided with the gate driver 230 in a manufacturing process.

According to the exemplary embodiments of the invention mentioned above, since the temperature sensor 250 is disposed adjacent to the gate driver 230, the temperature sensor 250 may sense a variation in temperature of an area adjacent to the gate driver 230. Accordingly, an accuracy and a reliability of the sensed temperature may be improved.

In the exemplary embodiment, the display panel 100 is a light-receiving type display panel, and thus a light source unit may be disposed to provide a light to the display panel 100. The display panel 100 and the light source unit may have various positional relationships depending on products.

FIG. 2 shows light source units LUA, LUB, LUC, and LUD as a dotted line in areas prepared for the light source units as an example. The light source units LUA, LUB, LUC, and LUD will be referred to as first, second, third, and fourth light source units LUA, LUB, LUC, and LUD, respectively.

The display panel 100 has a rectangular shape including a first side 101 and a second side 101*a*, which extend in the second direction DR2, and a third side 102 and a fourth side 102*a*, which extend in the first direction DR1. The first light source unit LUA is disposed adjacent to the first side 101, the second light source unit LUB is disposed adjacent to the second side 101*a*, the third light source unit LUC is disposed adjacent to the third side 102, and the fourth light source unit LUD is disposed adjacent to the fourth side 102*a*.

The temperature in the display panel 100 may be changed depending on a distance from the light source unit. As an example, in a case that the display device DD (refer to FIG. 1) includes only the first light source unit LUA, the temperature in the area in which the first gate driver 231 is disposed may be higher than the temperature in the area in which the second gate driver 232 is disposed. On the other hand, in a case that the display device DD includes only the third light source unit LUC, a temperature of a third area DPAc of the display panel 100 may be the lowest among those of first, second, and third areas DPAa, DPAb, and DPAc of the display panel 100. The first, second, and third areas DPAa, DPAb, and DPAc are sequentially defined along the second direction DR2 as shown in FIG. 2.

The position of the temperature sensor 250 may be determined to sense the temperature that is appropriate to compensate for the charges by taking into account the variation in temperature of the first and second gate drivers 231 and 232. This will be described in detail with reference to FIG. 3.

Figure 3:
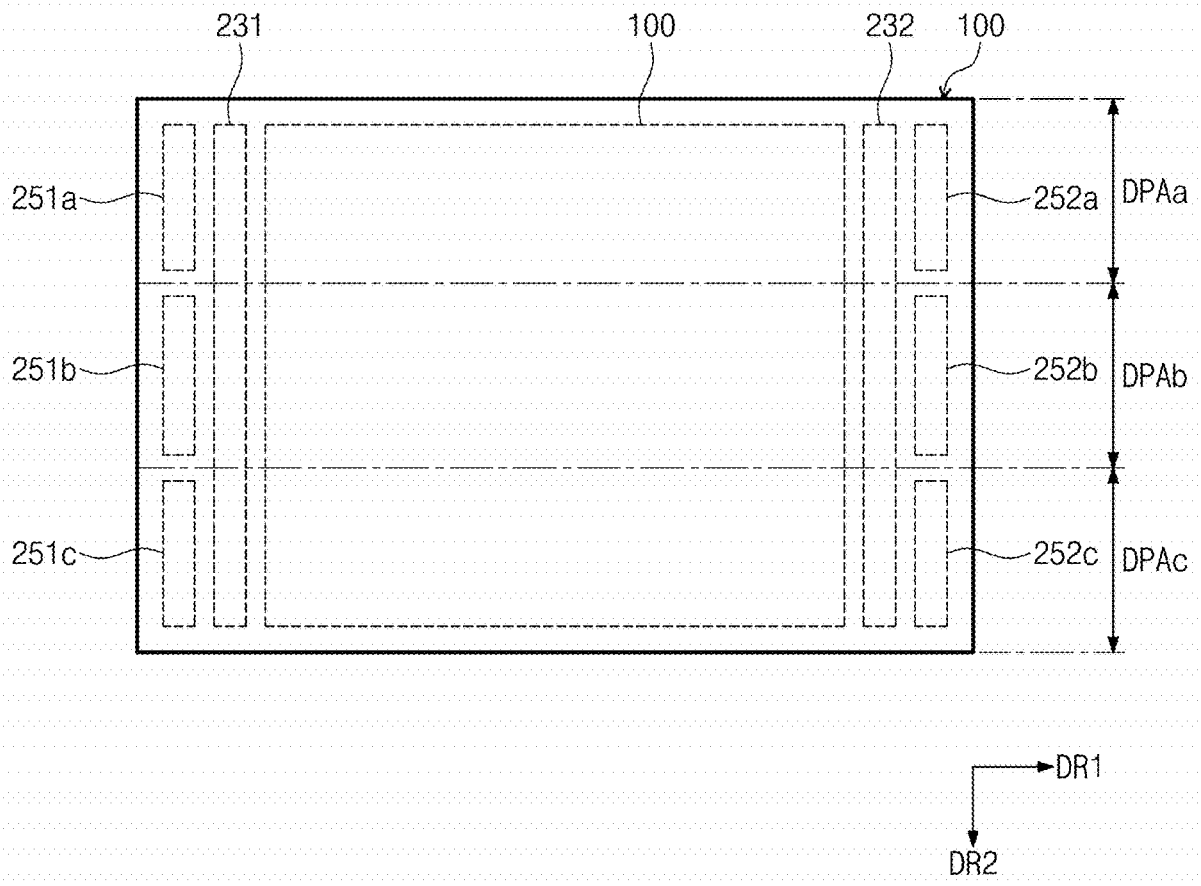
FIG. 3 is a plan view showing an exemplary embodiment of a display panel according to the invention.
Figure 4:
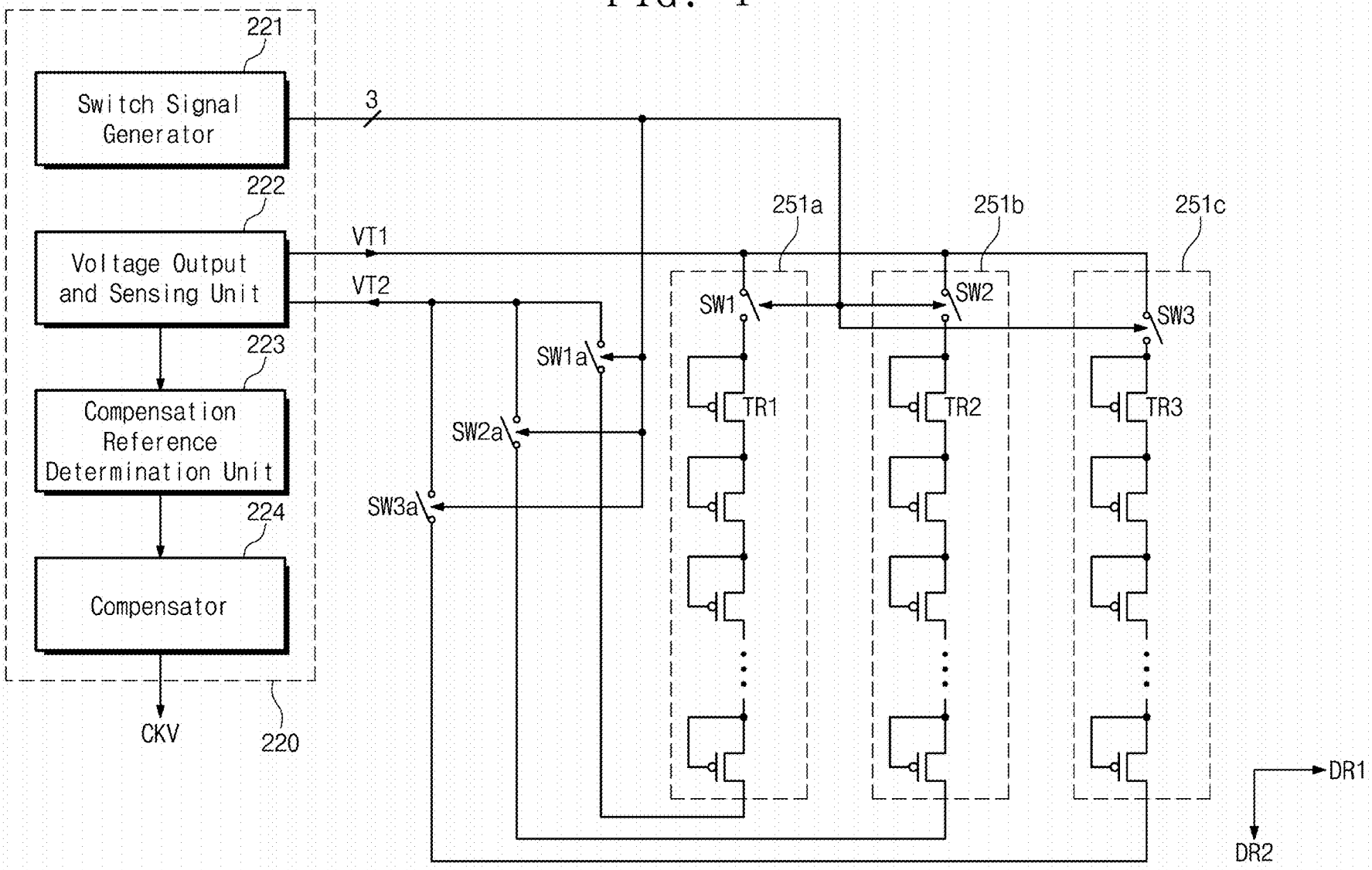
FIG. 4 is a block diagram showing an exemplary embodiment of a voltage generating circuit and an equivalent circuit diagram showing a temperature sensor according to the invention.

FIG. 3 is a plan view showing an exemplary embodiment of a display panel according to the invention, and FIG. 4 is a block diagram showing an exemplary embodiment of a voltage generating circuit and an equivalent circuit diagram showing a temperature sensor according to the invention.

Referring to FIGS. 3 and 4, the temperature sensor 250 (refer to FIG. 1) may include six temperature sensing circuits, for example, first, second, third, fourth, fifth, and sixth temperature sensing circuits 251*a*, 251*b*, 251*c*, 252*a*, 252*b*, and 252*c*. The first, second, and third temperature sensing circuits 251*a*, 251*b*, and 251*c* are disposed adjacent to the first gate driver 231 and sequentially arranged in the second direction DR2 in the order shown in FIG. 3. The fourth, fifth, and sixth temperature sensing circuits 252*a*, 252*b*, and 252*c* are disposed adjacent to the second gate driver 232 and sequentially arranged in the second direction DR2 in the order shown in FIG. 3.

The first and second gate drivers 231 and 232 are disposed on the first area DPAa, the second area DPAb, and the third area DPAc. The first and fourth temperature sensing circuits 251*a* and 252*a* are disposed in the first area DPAa of the display panel 100, the second and fifth temperature sensing circuits 251*b* and 252*b* are disposed in the second area DPAb of the display panel 100, and the third and sixth temperature sensing circuits 251*c* and 252*c* are disposed in the third area DPAc of the display panel 100.

Each of the first, second, third, fourth, fifth, and sixth temperature sensing circuits 251*a*, 251*b*, 251*c*, 252*a*, 252*b*, and 252*c* includes a plurality of diode-connected transistors. The first, second, third, fourth, fifth, and sixth temperature sensing circuits 251*a*, 251*b*, 251*c*, 252*a*, 252*b*, and 252*c* may include the same number of thin film transistors. FIG. 4 shows only the first, second, and third temperature sensing circuits 251*a*, 251*b*, and 251*c*. However, the fourth, fifth, and sixth temperature sensing circuits 252*a*, 252*b*, and 252*c* may have the same circuit configuration as the first, second, and third temperature sensing circuits 251*a*, 251*b*, and 251*c*.

The first temperature sensing circuit 251*a* includes a plurality of thin film transistors TR1. Each of the thin film transistors TR1 includes a control electrode, a first electrode, and a second electrode, and the control electrode is connected to the first electrode. The thin film transistors TR1 may be connected to each other in series as shown in FIG. 4. As the temperature decreases, a threshold voltage of each of the thin film transistors TR1 increases. In addition, since the thin film transistors TR1 are connected to each other in series, a degree of the voltage drop due to the temperature change may be easily measured.

A sum of the numbers of thin film transistors TR1, TR2, and TR3 of the first, second, and third temperature sensing circuits 251*a*, 251*b*, and 251*c* adjacent to the first gate driver 231 may be equal to the number of the gate lines GL1 to GLn (refer to FIG. 1), but the relation between the sum of the numbers of thin film transistors TR1, TR2, and TR3 and the number of the gate lines GL1 to GLn should not be limited thereto or thereby.

The voltage generating circuit 220 includes a switch signal generator 221, a voltage output and sensing unit 222, a compensation reference determination unit 223, and a compensator 224.

The switch signal generator 221 includes a decoder that converts an n-bit binary code value input thereto to other information. The switch signal generator 221 outputs the switch signal CB (refer to FIG. 1) to the temperature sensor 250 (refer to FIG. 1).

In a case that a switch of each of the first, second, third, fourth, fifth, and sixth temperature sensing circuits 251*a*, 251*b*, 251*c*, 252*a*, 252*b*, and 252*c* is separately turned on, the switch signal CB may include six information signals. On the other hand, in a case that the first and fourth temperature sensing circuits 251*a* and 252*a* arranged in the first area DPAa are substantially simultaneously turned on, the second and fifth temperature sensing circuits 251*b* and 252*b* arranged in the second area DPAb are substantially simultaneously turned on, and the third and sixth temperature sensing circuits 251*c* and 252*c* arranged in the third area DPAc are substantially simultaneously turned on, the switch signal CB may include three information signals. The first temperature sensing circuit 251*a* includes first switches SW1 and SW1*a*, the second temperature sensing circuit 251*b* includes second switches SW2 and SW2*a*, and the third temperature sensing circuit 251*c* includes third switches SW3 and SW3*a*. The voltage output and sensing unit 222 outputs the test voltage VT1 to the temperature sensor 250 (refer to FIG. 1). In a case that the first switches SW1 and SW1*a* are turned on in response to the switch signal CB, the test voltage VT1 is applied to the first temperature sensing circuit 251*a*. In a case that the second switches SW2 and SW2*a* are turned on in response to the switch signal CB, the test voltage VT1 is applied to the second temperature sensing circuit 251*b*. In a case that the third switches SW3 and SW3*a* are turned on in response to the switch signal CB, the test voltage VT1 is applied to the third temperature sensing circuit 251*c*.

The voltage output and sensing unit 222 receives the result voltage VT2. The result voltage VT2 has a voltage level dropped from the test voltage VT1 by the sum of the threshold voltages of the thin film transistors of the corresponding temperature sensing circuit.

The compensation reference determination unit 223 includes comparators. The compensation reference determination unit 223 receives a plurality of result voltages VT2 from the first, second, third, fourth, fifth, and sixth temperature sensing circuits 251*a*, 251*b*, 251*c*, 252*a*, 252*b*, and 252*c* and determines the result voltage VT2 having the largest voltage difference from the test voltage VT1 among the result voltages VT2 as a compensation reference.

The compensator 224 controls the level of the gate-on voltage and/or the gate-off voltage based on the determined result of the compensation reference determination unit 223 and outputs the clock signal CKV to the first and second gate drivers 231 and 232. The compensator 224 may determine a compensation level of the gate-on voltage and/or the gate-off voltage depending on the voltage difference between the test voltage VT1 and the result voltage VT2 using a look-up table or by calculating a voltage between predetermined maximum and minimum values of the compensation level by a linear interpolation or other operations. However, the compensation operation by the compensator 224 is not limited thereto. It may be changed in various ways.

Figure 5A:
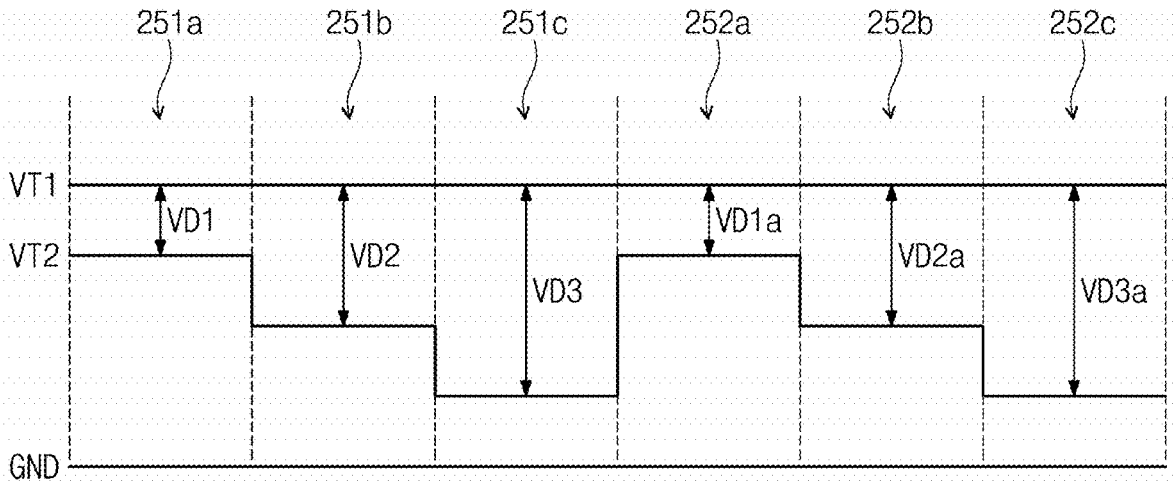
FIG. 5A is a view showing a test voltage and a result voltage according to an exemplary embodiment of the invention.

FIG. 5A is a view showing a ground voltage GND, the test voltage VT1, and the result voltage VT2 according to an exemplary embodiment of the invention. In detail, the result voltage VT2 indicates the result voltage measured when the third light source unit LUC (refer to FIG. 2) is disposed in the area adjacent to the third side 102 (refer to FIG. 2) of the display panel 100.

Referring to FIGS. 2, 3, and 5A, the first and fourth temperature sensing circuits 251*a* and 252*a* are arranged in the area nearest to the third light source unit LUC (refer to FIG. 2), and the third and sixth temperature sensing circuits 251*c* and 252*c* are arranged in the area farthest from the third light source unit LUC (refer to FIG. 2).

Among voltage drop amounts VD1, VD2, VD3, VD1*a*, VD2*a*, and VD3*a* of the first, second, third, fourth, fifth, and sixth temperature sensing circuits 251*a*, 251*b*, 251*c*, 252*a*, 252*b*, and 252*c*, the voltage drop amount VD3 and VD3*a* of the third and sixth temperature sensing circuits 251*c* and 252*c* is the largest voltage drop amount.

That is, the temperature of the areas in which the third and sixth temperature sensing circuits 251*c* and 252*c* are respectively disposed is the lowest temperature. Accordingly, the temperature compensation may be performed based on the voltage drop amounts VD3 and VD3*a* of the third and sixth temperature sensing circuits 251*c* and 252*c* to compensate for the lowered mobility of charges of the thin film transistors in the first and second gate drivers 231 and 232.

Figure 5B:
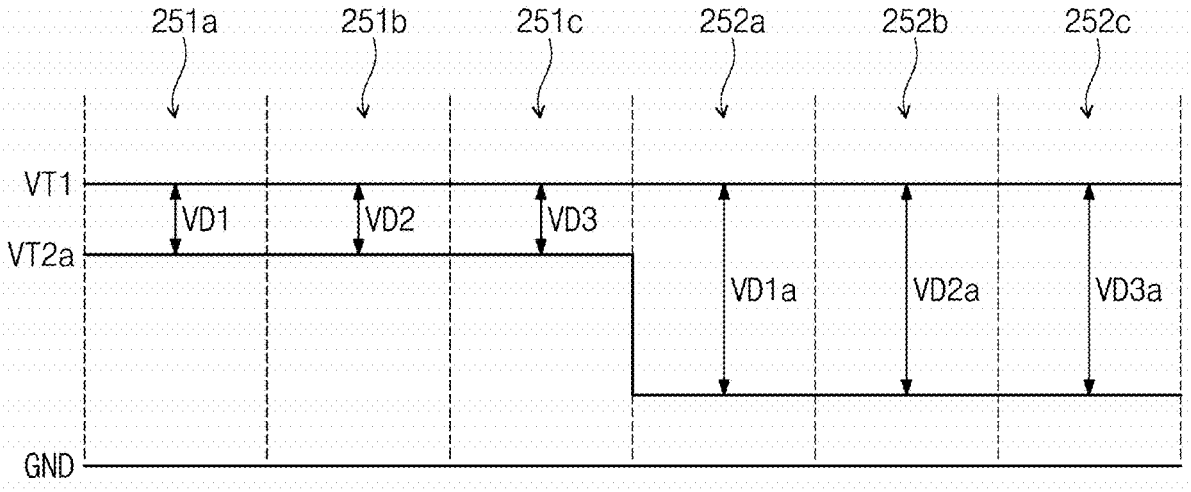
FIG. 5B is a view showing a test voltage and a result voltage according to another exemplary embodiment of the invention.

FIG. 5B is a view showing the ground voltage GND, the test voltage VT1, and a result voltage VT2*a* according to another exemplary embodiment of the invention. In detail, the result voltage VT2*a* indicates the result voltage measured when the first light source unit LUA (refer to FIG. 2) is disposed in the area adjacent to the first side 101 (refer to FIG. 2) of the display panel 100.

Referring to FIGS. 2, 3, and 5B, the first, second, and third temperature sensing circuits 251*a*, 251*b*, and 251*c* are arranged in the area nearest to the first light source unit LUA (refer to FIG. 2), and the fourth, fifth, and sixth temperature sensing circuits 252*a*, 252*b*, and 252*c* are arranged in the area farthest from the first light source unit LUA (refer to FIG. 2).

Among voltage drop amounts VD1, VD2, VD3, VD1*a*, VD2*a*, and VD3*a* of the first, second, third, fourth, fifth, and sixth temperature sensing circuits 251*a*, 251*b*, 251*c*, 252*a*, 252*b*, and 252*c*, the voltage drop amount VD1*a*, VD2*a*, and VD3*a* of the fourth, fifth, and sixth temperature sensing circuits 252*a*, 252*b*, and 252*c* is the largest voltage drop amount.

That is, the temperature of the areas in which the fourth, fifth, and sixth temperature sensing circuits 252*a*, 252*b*, and 252*c* are respectively disposed is the lowest temperature. Accordingly, the temperature compensation may be performed based on the voltage drop amounts VD1*a*, VD2*a*, and VD3*a* of the fourth, fifth, and sixth temperature sensing circuits 252*a*, 252*b*, and 252*c* to compensate for the lowered mobility of charges of the thin film transistors in the first and second gate drivers 231 and 232.

According to the exemplary embodiments above, although the positional relationship between the display panel 100 and the light source unit is changed in various ways, the voltage levels of the gate-on and -off voltages are compensated based on the result voltage having the largest voltage drop amount among the result voltages sensed by the temperature sensing circuits. That is, the voltage levels of the gate-on and -off voltages are adjusted to compensate for the lowered mobility of charges in the gate drivers of the lowest temperature, and thus the phenomenon in which the pixel PX is not sufficiently turned on is effectively prevented from occurring.

Figure 6:
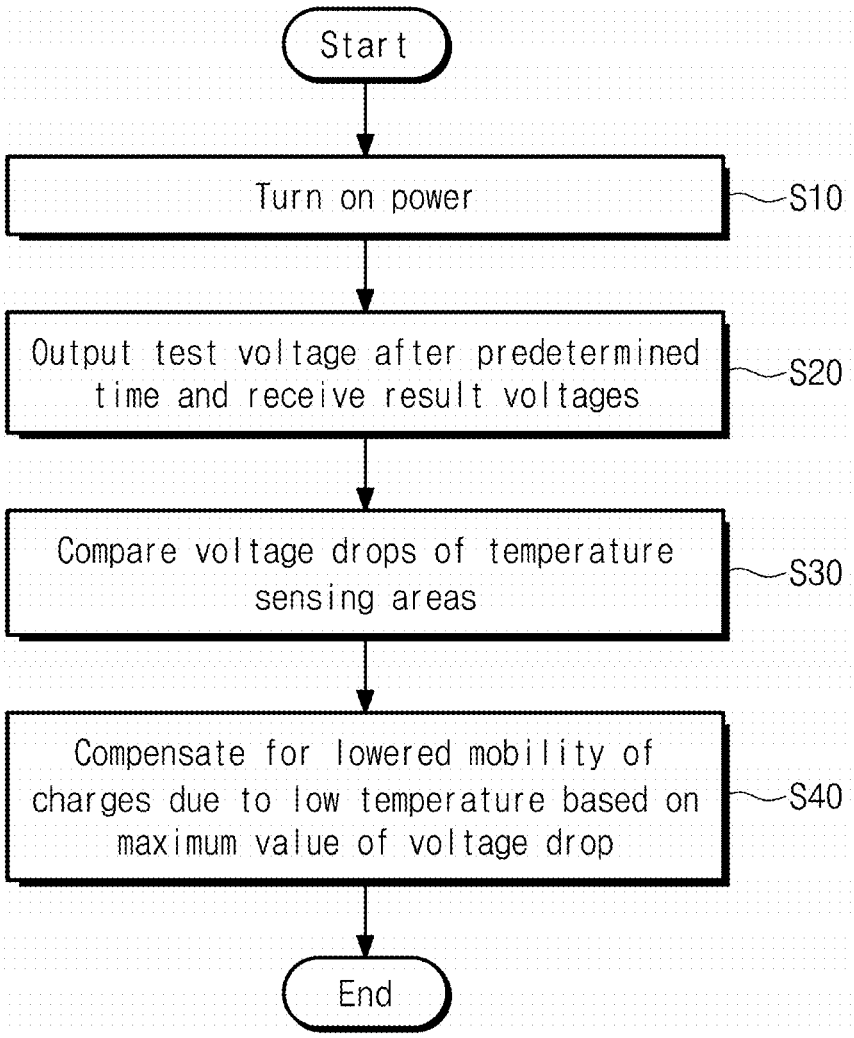
FIG. 6 is a flowchart showing an exemplary embodiment of a compensation operation of a gate driver according to the invention.

FIG. 6 is a flowchart showing an exemplary embodiment of a compensation operation of the gate driver 230 according to the invention.

Referring to FIGS. 1 and 6, the power of the display device DD is turned on (S10). The voltage generating circuit 220 outputs the test voltage VT1 to the temperature sensor 250 after a predetermined time and receives the result voltages VT2 (S20). The predetermined time may be an aging time for stabilizing the liquid crystal molecules in the display panel 100 by giving an electrical signal to the display panel 100 during a certain time.

The voltage generating circuit 220 compares the voltage drops of temperature sensing areas (S30). The temperature sensing areas correspond to the areas in which the temperature sensing circuits are disposed, and the area in which the thin film transistors are connected to each other in series is defined as one temperature sensing area.

The voltage generating circuit 220 performs the temperature compensation operation based on the maximum value among the voltage drops (S40). Accordingly, since the voltage levels of the gate-on and -off voltages are adjusted to compensate for the lowered mobility of charges in the gate drivers of the lowest temperature, the mobility of the charges of the thin film transistors in the gate driver 230 at low temperature may be compensated. Accordingly, the phenomenon in which the pixel PX is not sufficiently turned on may be effectively prevented from occurring.

Figure 7:
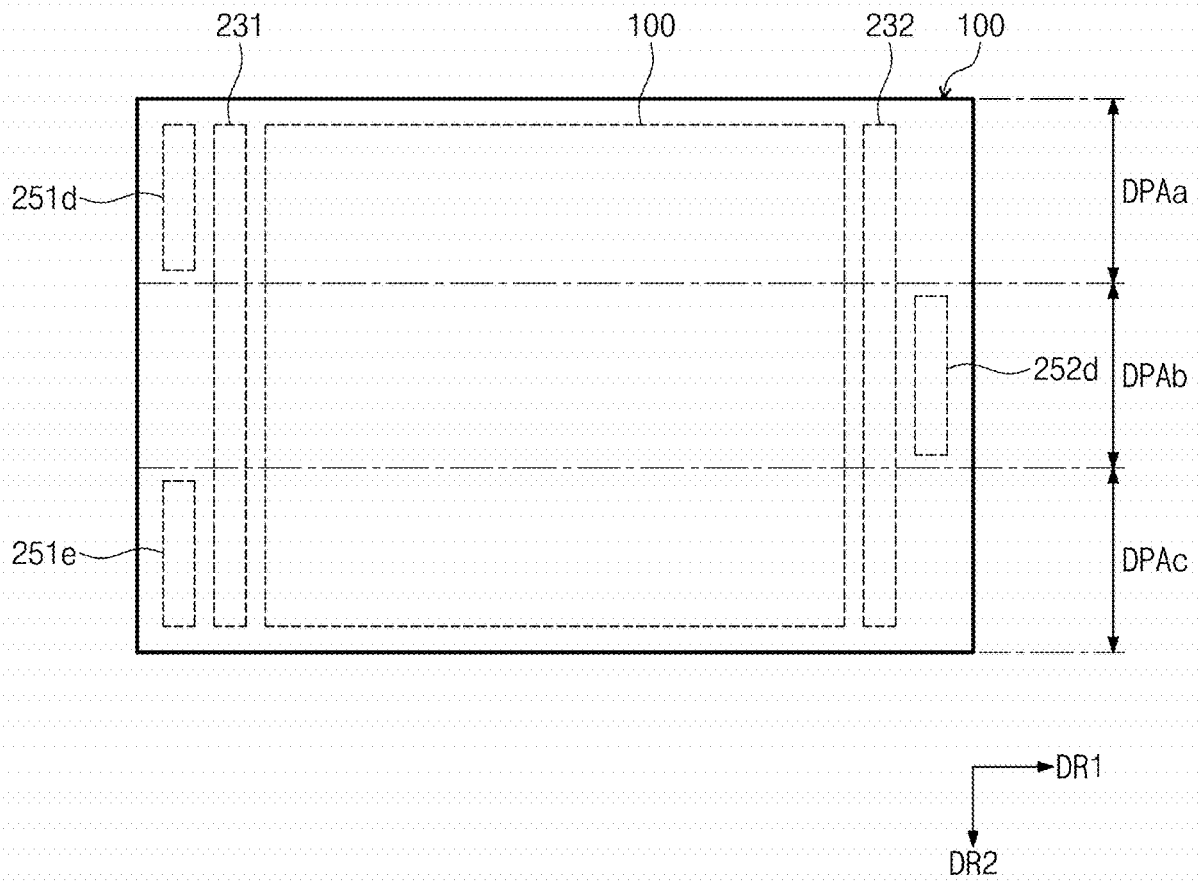
FIG. 7 is a plan view showing another exemplary embodiment of a display panel according to the invention.

FIG. 7 is a plan view showing another exemplary embodiment of a display panel according to the invention. In FIG. 7, the same reference numerals denote the same elements in FIG. 3, and thus detailed descriptions of the same elements will be omitted.

Referring to FIGS. 1 and 7, a temperature sensor 250 includes a first temperature sensing circuit 251*d*, a second temperature sensing circuit 252*d*, and a third temperature sensing circuit 251*e*.

The first temperature sensing circuit 251*d* is disposed in a first area DPAa, the second temperature sensing circuit 252*d* is disposed in a second area DPAb, and the third temperature sensing circuit 251*e* is disposed in a third area DPAc.

At least one temperature sensing circuit of the first, second, and third temperature sensing circuits 251*d*, 252*d*, and 251*e* is disposed adjacent to the first gate driver 231, and at least one temperature sensing circuit of remaining temperature sensing circuits is disposed adjacent to the second gate driver 232.

In FIG. 7, the first and third temperature sensing circuits 251*d* and 251*e* are disposed adjacent to the first gate driver 231, and the second temperature sensing circuit 252*d* is disposed adjacent to the second gate driver 232, but locational relationships between temperature sensing circuits and gate drivers should not be limited thereto or thereby.

In another exemplary embodiment, the first temperature sensing circuits 251*d* disposed in the first area DPAa and the second temperature sensing circuits 252*d* disposed in the second area DPAb may be disposed adjacent to the first gate driver 231, and the third temperature sensing circuit 251*e* disposed in the third area DPAc may be disposed adjacent to the second gate driver 232. In still another exemplary embodiment, the first temperature sensing circuit 251*d* disposed in the first area DPAa may be disposed adjacent to the first gate driver 231, and the second temperature sensing circuits 252*d* disposed in the second area DPAb and the third temperature sensing circuits 251*e* disposed in the third area DPAc may be disposed adjacent to the second gate driver 232.

Referring to FIGS. 2 and 7 again, although the display device DD (refer to FIG. 1) includes at least one of the first light source unit LUA, the second light source unit LUB, the third light source unit LUC, and the fourth light source unit LUD, the lowest temperature area may be sensed by the first, second, and third temperature sensing circuits 251*d*, 252*d*, and 251*e*. Accordingly, the voltage level of the clock signal CKV applied to the first and second gate drivers 231 and 232 may be corrected based on temperature information of the lowest temperature area. As a result, the phenomenon in which the pixel PX (refer to FIG. 1) is not sufficiently turned on may be effectively prevented from occurring.

Figure 8:
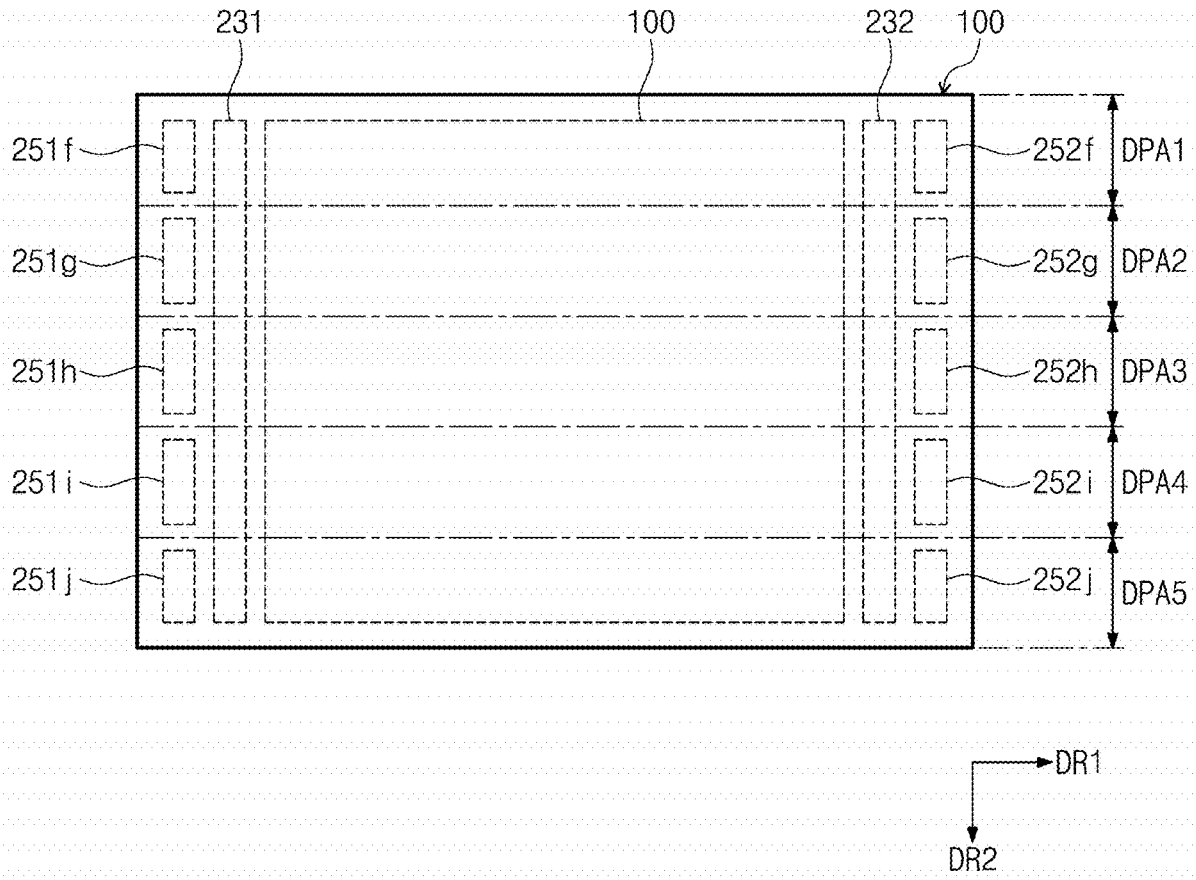
FIG. 8 is a plan view showing still another exemplary embodiment of a display panel according to the invention.

FIG. 8 is a plan view showing still another exemplary embodiment of a display panel according to the invention. In FIG. 8, the same reference numerals denote the same elements in FIG. 3, and thus detailed descriptions of the same elements will be omitted.

Referring to FIGS. 1 and 8, a temperature sensor 250 includes first, second, third, fourth, fifth, sixth, seventh, eighth, ninth, and tenth temperature sensing circuits 251*f*, 251*g*, 251*h*, 251*i*, 251*j*, 252*f*, 252*g*, 252*h*, 252*i*, and 252*j*. The first, second, third, fourth, and fifth temperature sensing circuits 251*f*, 251*g*, 251*h*, 251*i*, and 251*j* are disposed adjacent to the first gate driver 231, and the sixth, seventh, eighth, ninth, and tenth temperature sensing circuits 252*f*, 252*g*, 252*h*, 252*i*, and 252*j* are disposed adjacent to the second gate driver 232.

The display panel is divided into first, second, third, fourth, and fifth areas DPA1, DPA2, DPA3, DPA4, and DPA5, and the first, second, third, fourth, and fifth areas DPA1, DPA2, DPA3, DPA4, and DPA5 are sequentially defined in the second direction DR2.

The first, second, third, fourth, and fifth temperature sensing circuits 251*f*, 251*g*, 251*h*, 251*i*, and 251*j* are disposed in the first, second, third, fourth, and fifth areas DPA1, DPA2, DPA3, DPA4, and DPA5 respectively, and the sixth, seventh, eighth, ninth, and tenth temperature sensing circuits 252*f*, 252*g*, 252*h*, 252*i*, and 252*j* are disposed in the first, second, third, fourth, and fifth areas DPA1, DPA2, DPA3, DPA4, and DPA5 respectively.

The number of the temperature sensing circuits may be changed depending on a size of the display panel 100. As an example, as the size of the display panel 100 increases, the number of the temperature sensing circuits may increase. In addition, in order to sense the lowest temperature area in more detail, the display panel may be divided into more areas. Accordingly, the number of the temperature sensing circuits may increase. The number of the temperature sensing circuits should not be limited to the above-mentioned exemplary embodiments and may be changed in various ways.

As described above, optimal exemplary embodiments have been disclosed in the drawings and the specification. Although specific terms have been used herein, these are only intended to describe the exemplary embodiments above and are not intended to limit the meanings of the terms or to restrict the scope of the accompanying claims. Accordingly, those skilled in the art will appreciate that various modifications and other equivalent exemplary embodiments are possible from the above exemplary embodiments. Therefore, the scope of the claims should be defined by the technical spirit of the specification.

What is claimed is:

1. A display device comprising:

a display panel which comprises a plurality of gate lines extending in a first direction and a plurality of data lines extending in a second direction crossing the first direction;

a gate driver electrically connected to the gate lines;

a temperature sensor which comprises at least three temperature sensing circuits which are disposed adjacent to the gate driver; and a voltage generating circuit which outputs a test voltage to each of the temperature sensing circuits and outputs a clock signal, which is compensated based on a result voltage having a lowest voltage level among result voltages provided from the temperature sensing circuits, to the gate driver.

2. The display device of claim 1, wherein each of the temperature sensing circuits comprises a plurality of diode-connected transistors connected to each other in series.

3. The display device of claim 1, wherein the gate driver comprises a first gate driver and a second gate driver, the first gate driver and the second gate driver are disposed spaced apart from each other such that the gate lines are disposed between the first gate driver and the second gate driver, and the temperature sensing circuits are disposed adjacent to the first gate driver or the second gate driver in the first direction.

4. The display device of claim 3, wherein the display panel comprises a first area, a second area, and a third area, which are sequentially defined in the second direction, and the temperature sensor comprises a first temperature sensing circuit disposed in the first area, a second temperature sensing circuit disposed in the second area, and a third temperature sensing circuit disposed in the third area.

5. The display device of claim 4, wherein at least one temperature sensing circuit among the first, second, and third temperature sensing circuits is disposed adjacent to the first gate driver, and at least one remaining temperature sensing circuit among the first, second, and third temperature sensing circuits is disposed adjacent to the second gate driver.

6. The display device of claim 4, wherein the temperature sensor further comprises a fourth temperature sensing circuit disposed in the first area, a fifth temperature sensing circuit disposed in the second area, and a sixth temperature sensing circuit disposed in the third area, the first, second, and third temperature sensing circuits are disposed adjacent to the first gate driver, and the fourth, fifth, and sixth temperature sensing circuits are disposed adjacent to the second gate driver.

7. The display device of claim 4, wherein a number of first diode-connected transistors included in the first temperature sensing circuit, a number of second diode-connected transistors included in the second temperature sensing circuit, and a number of third diode-connected transistors included in the third temperature sensing circuit are equal to each other.

8. The display device of claim 7, wherein a sum of the number of first diode-connected transistors, the number of second diode-connected transistors, and the number of third diode-connected transistors is equal to a number of the gate lines.

9. The display device of claim 4, wherein the first temperature sensing circuit comprises a first switch, the second temperature sensing circuit comprises a second switch, the third temperature sensing circuit comprises a third switch, and the first, second, and third switches are sequentially turned on, receive the test voltage from the voltage generating circuit, and output the result voltages changed depending on a temperature of the first gate driver or the second gate driver adjacent thereto to the voltage generating circuit.

10. The display device of claim 9, wherein the voltage generating circuit comprises:

a switch signal generator which generates a signal to sequentially turn on the first switch, the second switch, and the third switch;

a voltage output and sensing unit which outputs the test voltage and receiving the result voltages;

a compensation reference determination unit which compares voltage drops from the test voltage to the result voltages to determine a compensation reference; and a compensator which compensates for the clock signal based on the compensation reference.

11. The display device of claim 2, wherein the diode-connected transistors included in each of the temperature sensing circuits are arranged along the second direction.

12. A display device comprising:

a display panel which comprises a plurality of gate lines extending in a first direction and a plurality of data lines extending in a second direction crossing the first direction and comprises a first area, a second area, and a third area, which are sequentially defined along the second direction;

a gate driver which outputs a gate signal to the gate lines and disposed in the first, second, and third areas;

a temperature sensor which comprises a first temperature sensing circuit disposed in the first area, a second temperature sensing circuit disposed in the second area, and a third temperature sensing circuit disposed in the third area which are adjacent to the gate driver; and a voltage generating circuit which outputs a test voltage to each of the first, second, and third temperature sensing circuits and outputs a clock signal, which is compensated based on first, second, and third result voltages provided from the first, second, and third temperature sensing circuits respectively, to the gate driver.

13. The display device of claim 12, wherein the voltage generating circuit compares the test voltage with each of the first, second, and third result voltages and compensates for the clock signal based on a voltage having a largest voltage drop among voltage drops from the test voltage to the first, second, and third result voltages.

14. The display device of claim 12, wherein the gate driver comprises a first gate driver and a second gate driver, the first gate driver and the second gate driver are disposed to be spaced apart from each other such that the gate lines are disposed between the first gate driver and the second gate driver, and the first, second, and third temperature sensing circuits are disposed adjacent to the first gate driver or the second gate driver in the first direction.

15. The display device of claim 14, wherein at least one temperature sensing circuit among the first, second, and third temperature sensing circuits is disposed adjacent to the first gate driver, and at least one remaining temperature sensing circuit among the first, second, and third temperature sensing circuits is disposed adjacent to the second gate driver.

16. The display device of claim 14, wherein the temperature sensor further comprises a fourth temperature sensing circuit disposed in the first area, a fifth temperature sensing circuit disposed in the second area, and a sixth temperature sensing circuit disposed in the third area, the first, second, and third temperature sensing circuits are disposed adjacent to the first gate driver, and the fourth, fifth, and sixth temperature sensing circuits are disposed adjacent to the second gate driver.

17. The display device of claim 13, wherein each of the first, second, and third temperature sensing circuits comprises a plurality of diode-connected transistors connected to each other in series.

18. A method of driving a display device comprising a display panel comprising a gate driver and first, second, and third temperature sensing circuits integrated in an area adjacent to the gate driver, the method comprising:

sequentially providing a test voltage to the first, second, and third temperature sensing circuits;

sequentially receiving first, second, and third result voltages, which are voltage-dropped from the test voltage, from the first, second, and third temperature sensing circuits respectively;

comparing the test voltage with each of the first, second, and third result voltages; and controlling a voltage level of a clock signal applied to the gate driver based on a result voltage having a largest voltage drop among the first, second, and third result voltages.

19. The method of claim 18, wherein the test voltage is provided after a predetermined time elapses from a time point at which the display device is turned on.

20. The method of claim 18, further comprising generating a switch signal to provide the test voltage to one of the first, second, and third temperature sensing circuits.

* * * * *